US005143511A

United States Patent [19]

Verneau et al.

[11] Patent Number: 5,143,511

[45] Date of Patent: Sep. 1, 1992

[54] REGENERATIVE CENTRIFUGAL COMPRESSOR

[75] Inventors: Alain Verneau, Elancourt, France; Barry Dittler, Fayetteville, N.Y.

[73] Assignee: Lamson Corporation, Syracuse, N.Y.

[21] Appl. No.: 589,795

[22] Filed: Sep. 28, 1990

[51] Int. Cl.[5] ..... F04D 29/16

[52] U.S. Cl. ..... 415/55.4; 415/172.1

[58] Field of Search ..... 415/55.1, 55.2, 55.3, 415/55.4, 55.6, 55.7, 172.1, 174.4; 277/53, 57

[56] References Cited

U.S. PATENT DOCUMENTS

| | | | |
|---|---|---|---|
| 1,973,669 | 9/1934 | Spoor | 415/55.7 |
| 2,217,211 | 10/1940 | Brady | 415/55.4 |
| 2,305,619 | 12/1942 | Jennings . | |
| 2,578,780 | 12/1951 | Bower | 415/55.4 |
| 3,292,899 | 12/1966 | Egli . | |
| 3,666,276 | 5/1972 | Hubler | 277/53 |
| 3,915,589 | 10/1975 | Vander Linden | 415/55.4 |
| 4,279,570 | 7/1981 | Egli et al. . | |
| 4,306,833 | 12/1981 | Sixsmith et al. . | |
| 4,325,672 | 4/1982 | Sixsmith et al. | 415/55.1 |
| 4,412,781 | 11/1983 | Abe et al. | 415/55.4 |
| 4,460,185 | 7/1984 | Grandey | 277/53 |
| 4,566,700 | 1/1986 | Shiembob | 277/53 |
| 4,948,344 | 8/1990 | Cygnor | 415/55.1 |

FOREIGN PATENT DOCUMENTS

| | | | |
|---|---|---|---|
| 1817430 | 10/1969 | Fed. Rep. of Germany . | |
| 1925949 | 12/1970 | Fed. Rep. of Germany . | |
| 2305619 | 3/1975 | France . | |
| 2273176 | 4/1975 | France . | |
| 18497 | 1/1982 | Japan | 415/55.4 |
| 105296 | 5/1988 | Japan | 415/55.4 |
| 8906318 | 7/1989 | World Int. Prop. O. . | |

OTHER PUBLICATIONS

Morgan Groege T., Regenerative Blowers: High Flow at Low Cost, Machine Design, Jul. 24, 1986.

Universal RAI Rotary Positive Blowers (Product Description) Dresser Industries, Roots Div., Apr. 1, 1988.

Rotron Regenerative Blowers Product Guide, EG & G Rotron Industrial Division, Nov. 1988.

Yamamoto Toshiyoshi, Eddy Flow Fan—Japan Abstract.

*Primary Examiner*—Edward K. Look
*Assistant Examiner*—Michael S. Lee
*Attorney, Agent, or Firm*—Wall and Roehrig

[57] ABSTRACT

A regenerative centrifugal compressor has an impeller disk with axial impeller blades on either side of the impeller disk rim, and a support housing for rotationally supporting a drive shaft for the impeller disk, and also defining annular compression chambers that respectively surround one or the other of the rows of impeller blades. The annular compression chambers extend in the rotation direction of the impeller from an inlet to an outlet, with a stripper section extending from the outlet to the inlet in the rotation direction. Stripper seal inserts formed of a low-friction material softer than the impeller blades are fastened into stripper receptacles on either side of the housing at the stripper section. A baffle at the inlet conducts inlet air around the impeller to a radially inward side thereof. Annular running seals are provided between the rim of the impeller disk and the housing. The blades of the impeller are shaped for optimal efficiency and compression.

20 Claims, 7 Drawing Sheets

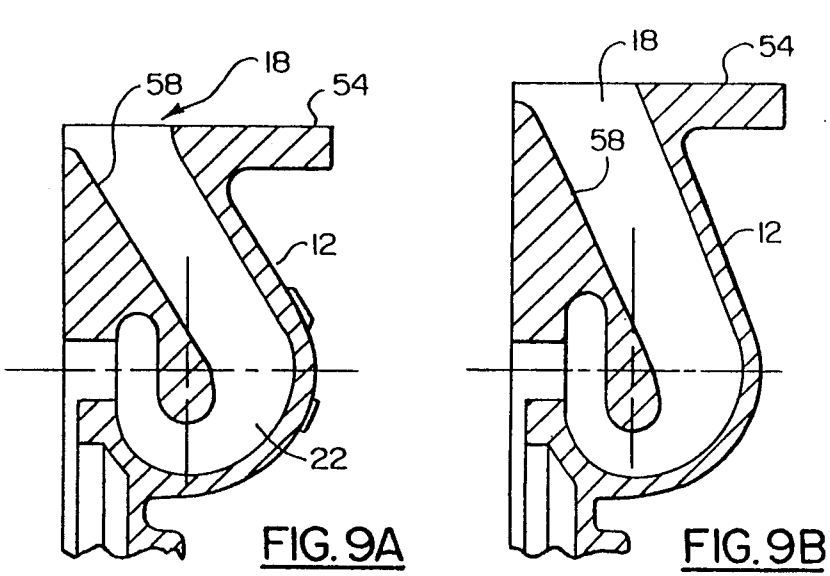
FIG. 9A
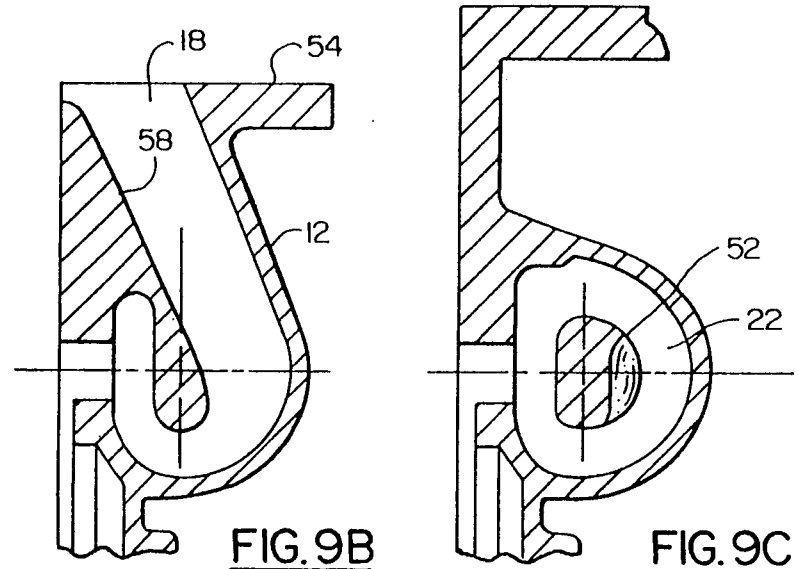
FIG. 9B
FIG. 9C
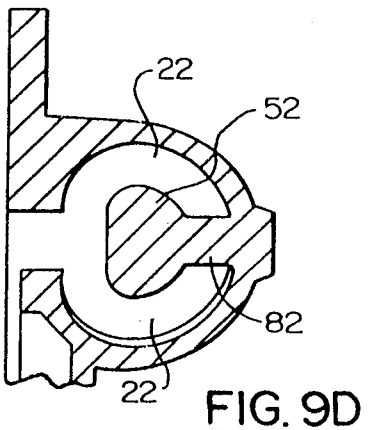
FIG. 9D
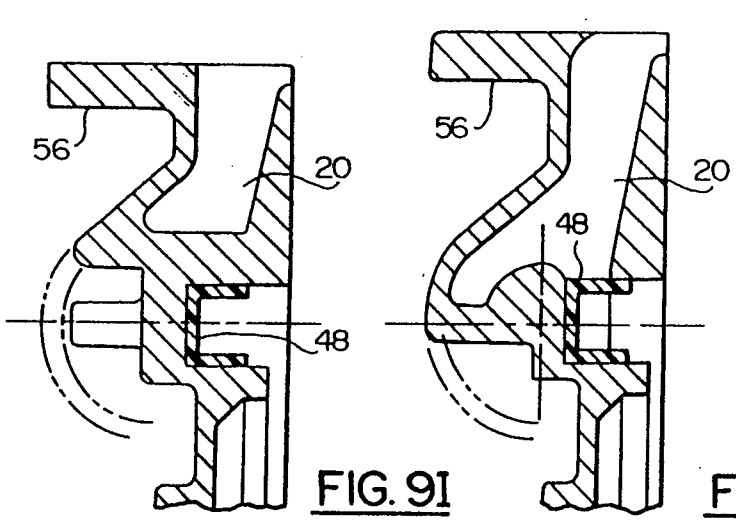
FIG. 9I
FIG. 9H
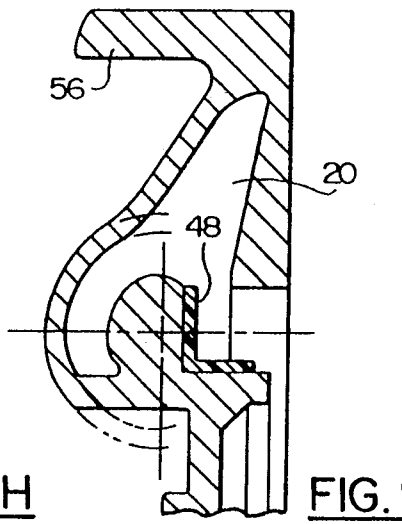
FIG. 9G
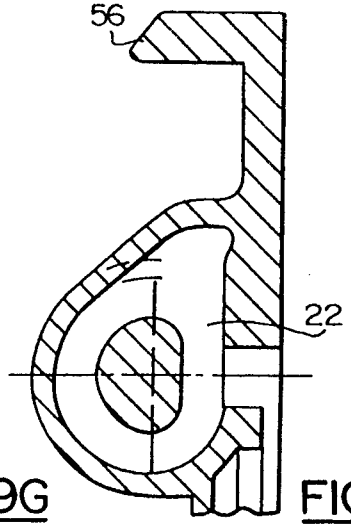
FIG. 9F

REGENERATIVE CENTRIFUGAL COMPRESSOR

BACKGROUND OF THE INVENTION

This invention is directed to regenerative centrifugal pumps or blowers, and is more particularly concerned with improved regenerative devices having greater efficiency and power.

Regenerative compressors are rotor-dynamic fluid handling machines that, with a single bladed impeller disk, achieve a compression ratio that is the equivalent of several centrifugal stages having the same blade tip speed. The impeller disk can have a set of blades, or vanes, projecting axially at one or both sides of the disk rim. A housing encases the impeller disk and defines annular compression chambers between an inlet port and an outlet or discharge port. A stripper seal is provided between the outlet port and the inlet port. This stripper seal achieves a close clearance over the blades so that only the gas present between the vanes passes from the outlet port back into the inlet port end of the compression chamber.

Each annular compression chamber has a cross section that is more or less circular, and a solid core can be provided at the tip of the vanes or blades. The blades drive gasses in the chamber radially outward, and the gasses are guided by the core and the chamber walls back to the radially inward, or intake, edge of the impeller blades, which then again propel the gases outwards. The gasses follow a generally helical path encountering the impeller blades several times in the course of their journey through the compression chamber. Each passage through the vanes or blades compresses the gasses, and is the equivalent of a single stage of conventional centrifugal compression.

However, these machines have had limited applicability because of limited efficiency and tendency to dissipate power. Generally, regenerative centrifugal compressors have an efficiency of fifty percent or less. A great deal of turbulence is created in the compression chamber because gas is ejected into gasses already in the chamber. Also, previous designs for stripper seals have been unable to avoid problems of leakage and noise, and require a relatively large clearance for the impeller blades.

On the other hand, these compressors are often preferable to the more efficient reciprocal compressors, especially in applications that require high reliability and which must be relatively free of operation or maintenance problems. Pumps of similar design have also been employed for pumping liquids.

Blowers and compressors can be categorized in terms of their efficiency factors, flow rates, and output pressure. Generally, piston type compressors have relatively high output pressures and low volume with high efficiency factors often approaching 80%. Rotary machines such as Roots blowers or lobed blowers have much higher operating speeds than piston type compressors, and delivers intermediate output pressures at larger volumes. These typically have an output efficiency on the order of 60%. A third category of machines is rotary type turbo machines which can be radial, axial, or mixed flow types. One of these is the regenerative type, or so-called "drag pump", which typically has a low output pressure at high volume, and an efficiency on the order of 40% to 50%. Multistage turbine compressors are employed to develop higher output pressures.

The regenerative blower has operating characteristics similar to a Roots blower, but also has some operating advantages. These advantages include compact size, quiet operation, clean and pulse-free discharge of air, simple construction and freedom from maintenance problems. One noted disadvantage of regenerative blowers, however, has been its low efficiency as compared with the Roots type blower.

Regenerative compressors, or blowers, are useful in applications such as agitation, blowing, cooling, or drying, and for transfer of process gasses or transfer of bulk materials by pneumatic conveying.

OBJECTS AND SUMMARY OF THE INVENTION

It is an object of this invention to provide a regenerative centrifugal pump or blower which has improved efficiency.

It is another object to provide a regenerative centrifugal compressor with improved compression characteristics and reduced leakage characteristics.

It is an object of this invention to provide a regenerative centrifugal pump or compressor which has reduced leakage, better inlet entry, and hence improved efficiency.

It is another object to provide a regenerative reciprocal compressor with a more efficient and powerful impeller which has an increased load capacity.

It is a further object of this invention to provide a regenerative centrifugal compressor with a more effective, serviceable stripper seal, and hence improved reliability.

According to an aspect of the present invention, a regenerative centrifugal compressor has a roto-dynamic impeller with one or two rows of blades projecting axially from the periphery of a rotor disk, which, together with associated housing, defines a pair of annular compression chambers. The housing has an air or gas inlet and an exhaust or outlet port, with a compression chamber extending from the inlet port to the outlet port in the rotation direction of the impeller. An annular core with a D-shaped cross section is present, and extends within the compression chamber alongside the axial tips of the impeller blades from the inlet port, where its end is integrally formed with the inlet baffle, to the outlet port. A stripper seal has a passage with substantially the same cross section as the impeller blade profile and extends from the outlet port to the inlet port so that the compressed gasses at the outlet are stripped and forced out from the flow chamber.

In such a compressor, the gasses, or flow, follow a helical path throughout the flow channel. First, the gas is sucked in at the inlet, and is then led to the leading edge of the impeller blades through the inlet baffle. The rotating impeller drives the gas from the leading edge of the blades to the trailing edge, increasing both its velocity and pressure. Then the gas enters the vaneless flow chamber where part of the velocity is recovered as pressure. After that, it is ready to reenter the leading edge of blades again. This process is repeated until the compressed gas encounters the stripper seal where it is forced out. Each gas acceleration stage in this process can be regarded as equivalent to one stage of compression of conventional compressors, which will add up to a multistage compression from the inlet port to the outlet port.

Due to the relatively high pressure developed through this multiple compression process, a new seal design is provided in the present invention, which can minimize the leakage losses on the one hand, and overcome the metallic seizure failure caused by thermal expansion on the close tolerance clearance design of the housing and rotor.

In general, a clearance is necessary between moving parts and stationary parts where leakage will occur wherever there is a pressure gradient. This leakage can be very significant at the stripper area where there exists a large pressure gradient between the inlet port and the outlet port, and at the impeller inner rim where there is a large pressure difference between the flow channel and the impeller hub.

The previous approach to this problem was to maintain as close clearance as possible. The problems with this approach are that it makes manufacturing more difficult, and it can result in a metal-to-metal collision, or rubbing, due to thermal expansion, especially under high loads.

This invention uses a pair of inner running seals between the impeller inner rim and the mating parts of the housing, and a pair of outer running seals disposed between the outer rim of the impeller and the housing. A pair of stripper seals disposed between the inlet and outlet port are softer than the impeller material. A close clearance can be maintained between the impeller and the stripper seal. If the impeller blades hit the seal, the collision will not cause mechanical failure.

Another advantage of the present invention is the improvement of its efficiency and increase of its load capacity.

An inlet baffle is used to improve the entry condition of the flow.

Another improvement is in the design of the impeller blade profile. In addition to employing forward-curved blades to allow for high energy transfer between the impeller and gas inside the impeller, the flow passage between successive blades has a diffusing feature so more pressure can be developed inside the impeller with a better efficiency (i.e., 20% flow deceleration inside the impeller).

In an embodiment of the present invention, the compressor has an impeller or rotor disk that is rotationally supported in a housing. There are two rows of axial impeller blades at the rim of the rotor disk, and the housing defines a pair of annular compression chambers, with the two rows of blades each travelling through a respective one of the compression chambers. The housing has an air or gas inlet port and an exhaust or outlet port, with the compression chambers extending from the inlet port to the outlet port in the rotation direction of the impeller disk. At the inlet port, inlet baffles guide the intake air (or other gas) around the blades and compression chamber to enter the chamber at the low pressure, i.e. radially inward, side of the impeller blades.

The compression chambers are generally round in cross section, and each includes an annular core that extends within the compression chamber alongside the axial tips of the impeller blades to define a torsional pathway for the gasses discharged from the blades. Each core extends from the inlet port, where its end is integrally formed with the inlet baffle, to the outlet port. The core favorably is of generally D-shaped cross section.

The stripper seal extends from the outlet port to the inlet port in the rotation direction of the impeller. The stripper seal has an open passage of substantially the same cross section as the impeller blade profile. Compressed gasses in the compression chamber are stripped from the impeller blades and blocked from flowing from the outlet around the blades to the inlet. In the preferred embodiment, the stripper seal includes respective channel member inserts formed of Teflon (i.e. PTFE) or another low-friction synthetic resin that is softer than the material (e.g. aluminum) of the impeller blades. The inserts fit into respective receptacles at the stripper region of the housing, i.e. between the outlet and inlet ports.

The stripper inserts are preferably in the form of an arcuate channel with a web portion that secures to the housing receptacles and inner and outer coaxial circumferential flanges disposed respectively at the intake and discharge edges of the impeller blades. The inner flange is of a greater circumferential extent than the outer flange, so that the spaces between successive impeller blades are closed off at their intake side before being closed off at their discharge side when the blades encounter the stripper seal. Also, the spaces open first at the outer, or discharge side, when the blades leave the stripper seal and enter the inlet region. This reduces the turbulence from compressed gasses that are carried in the spaces between blades from the outlet to the inlet regions.

For improved fluid dynamics, the blades are configured as forward sloping, with an L-shaped profile having a round inner, or intake edge, a generally straight lead-in portion, an arcuate bend, a generally straight exit portion, and a flat, narrow discharge outer edge. Successive blades define between them spaces that are each of gradually increasing width from the intake edges to the arcuate bends, and then continuing to open gradually from the arcuate bends to the discharge edges. This permits efficient diffusion of the gas. The two rows of blades are preferably staggered, so that blades on one side of the impeller disk are aligned with the spaces between blades on the other side of the disk.

Running seals, i.e. annular rings of Teflon or the like, can be disposed between the radially inward portion of the housing and a facing, generally cylindrical, surface of the rim of the impeller disk. These seals help contain compressed gasses in the compression chambers, without requiring small clearance between metal surfaces.

The regenerative compressor of this invention, with its inventive improvements, is quieter and more reliable than previous designs, and achieves a greater pressure ratio at improved efficiency. If the stripper seals become damaged, they can be easily replaced. However, after a short run-in period, there is no contact between the stripper seals and the impeller.

The above and many other objects, features, and advantages of this invention will become apparent to those skilled in the art from the ensuing description of a preferred embodiment, which should be read in conjunction with the accompanying Drawing.

BRIEF DESCRIPTION OF THE DRAWING

FIG. 8 is a partial elevational view of the preferred embodiment.

FIG. 9A to 9I are cross sectional views of one of the compression chambers, taken at 9A to 9I of FIG. 8, respectively.

DETAILED DESCRIPTION OF THE PREFERRED EMBODIMENT

Figure 1:
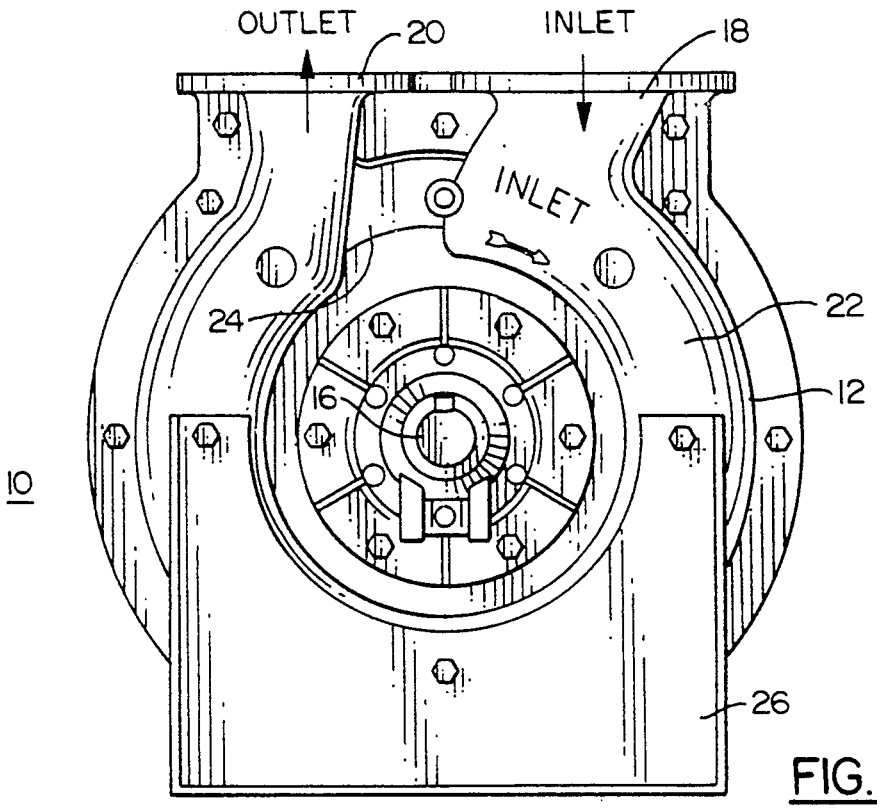
FIGS. 1 and 2 are left and right side elevations of a regenerative centrifugal compressor according to one preferred embodiment of this invention.
Figure 2:
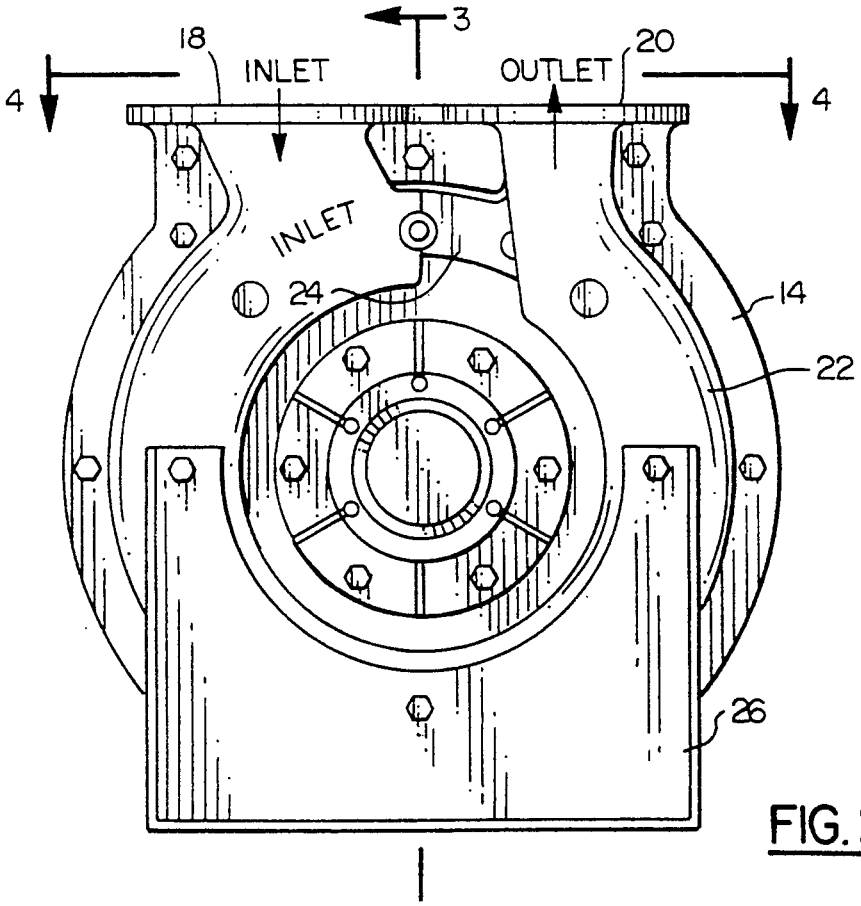

With reference to the Drawing, and initially to FIGS. 1 and 2, a compressor assembly 10 is shown to comprise a right housing half 12 and a left housing half 14. An impeller drive shaft 16 extends out a bearing support in the housing half 12. In this embodiment, the motor (not shown) is attached to the shaft 16 at the right housing half 12 as shown in FIG. 1.

The direction of rotation of the impeller shaft 16 is as indicated by an arrow, which can be embossed or molded on the housing.

An inner port 18 and an outer port 20 are provided at an upper part of the compressor assembly 10. A generally toroidal compression chamber 22 is formed in each half 12, 14 of the compressor housing, and each chamber 22 extends in the rotation direction from the inlet port 18 to the outlet port 20. A stripper portion 24 then continues in the rotation direction the short distance from the outlet port to the inlet port. Stands or feet 26 are attached onto the compressor assembly and serve for mounting the same.

Figure 3:
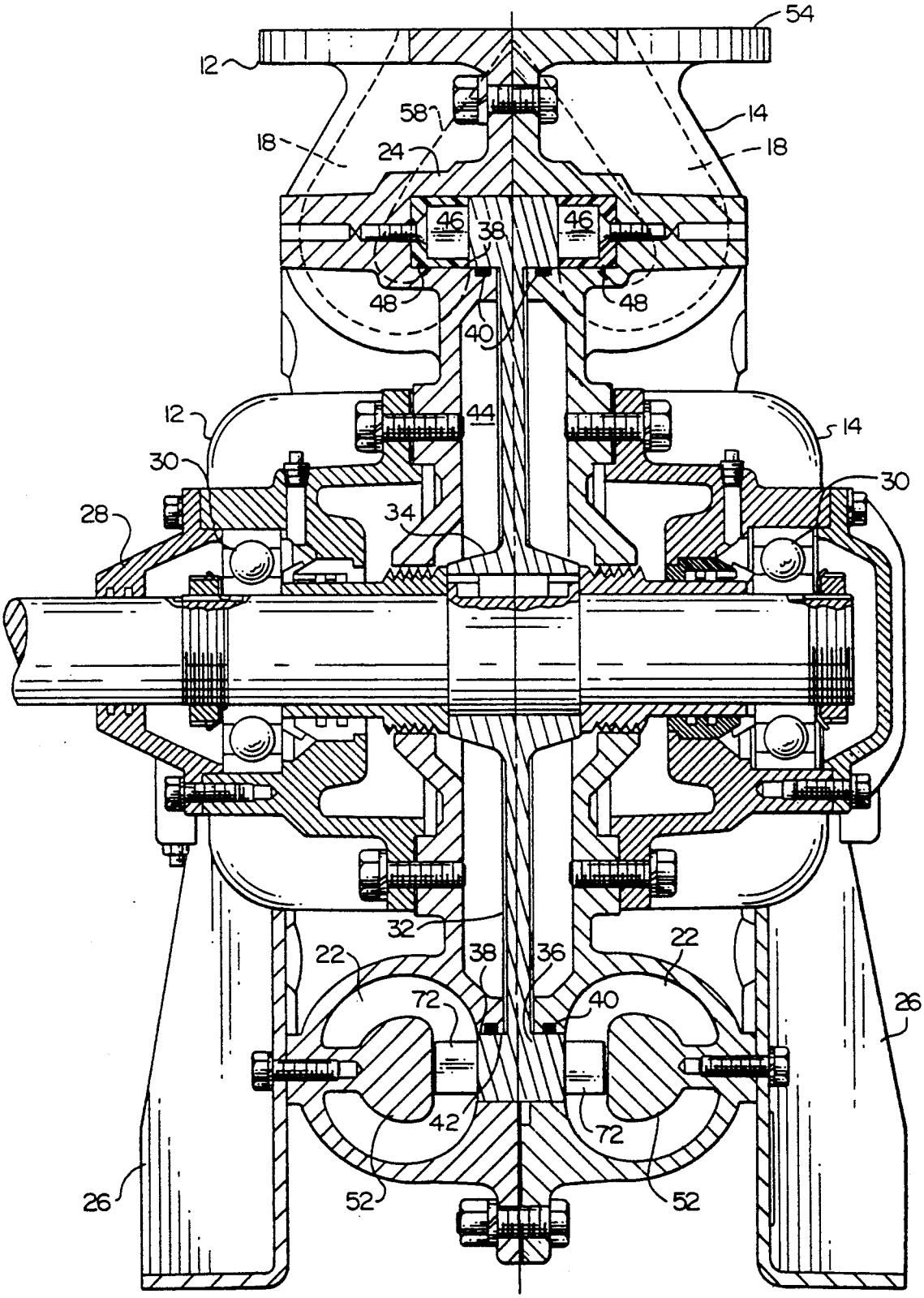
FIG. 3 is a sectional elevation taken at 3—3 of FIG. 2.

As shown in large detail in FIG. 3, the inlet port 18 has a J-shaped cross section, and inlet air is carried from the mouth of the inlet port 18 around to an underside or radially inward portion of the compression chamber 22 at the inlet port.

As also shown in FIG. 3, there is a shaft seal 28, which can be of labyrinth seal design, to seal the housing half 12 about the shaft 16. Bearings 30 of known design can support the shaft 16 rotationally.

Within the housing, and driven by the shaft 16, is an impeller disk 32 having a hub 34 that is mounted on the shaft, and a peripheral rim 36. The rim has a cylindrical surface 38 that faces radially inwards on either axial side of the disk 32. A low-friction ring-type running seal 40 is provided on an inner cylindrical face 42 of each housing half 12, 14 that faces a respective cylindrical surface 38. The seals 40 block the escape of high pressure gasses from the compression chamber 32 into a low-pressure enclosed area 44 between the hub 34 and the rim 36 of the impeller. If desired, outer running seals can be provided between outer cylindrical surfaces of the rim 36 and facing surfaces of the housing halves 12, 14. The running seals contain the gas flow without requiring close tolerance between metal surfaces that are moving at high speed relative to each other. In the case at hand, this reduces the manufacturing cost of the impeller and at the same time increases reliability of the blower or compressor. Sealing off the leakage also increases compressor efficiency. The running seals 40 also absorb the thermal expansion that occurs in operation due to the compression of air or other gas in the compression chamber.

As shown here generally, and in more detail later, on each axial face of the impeller rim 36 there is a respective row 46 of rotor blades which drive the air or other gasses centrifugally outward into the compression chamber for centrifugal compression, as the gas travels from the inlet port to the outlet port. Stripper seals 48 are provided in the form of inserts of a low-friction material that is softer than the rotor blades. The stripper seals are attached into receptacles 50 in the stripper area 24, with one such stripper seal 48 being attached into each one of the housing halves 12, 14. The open channel passages of the stripper seals have a cross section that matches the profile of the impeller blades 46, considered in the rotary direction, as shown in FIG. 3.

As also shown in FIG. 3, each of the chambers 26 has a generally annular core 52 at the center of the chamber adjacent the axial tips of the impeller blades. Here, the cores are of a generally D-shaped cross section. The cores have a straight, or generally flat, surface adjacent the blades and a generally round or torsional surface that, together with the inside of the chamber 22, defines a circular path of air discharged from the radially outward side of the blades back to the radially inward side thereof.

Figure 4:
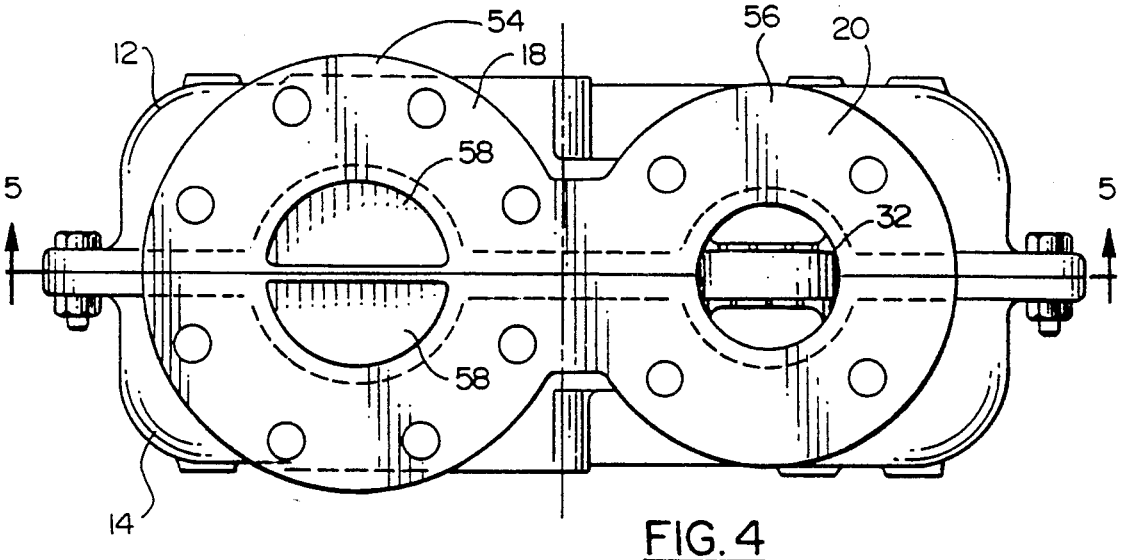
FIG. 4 is a top plan view of the compressor of this embodiment, taken at 4—4 of FIG. 2.
Figure 5:
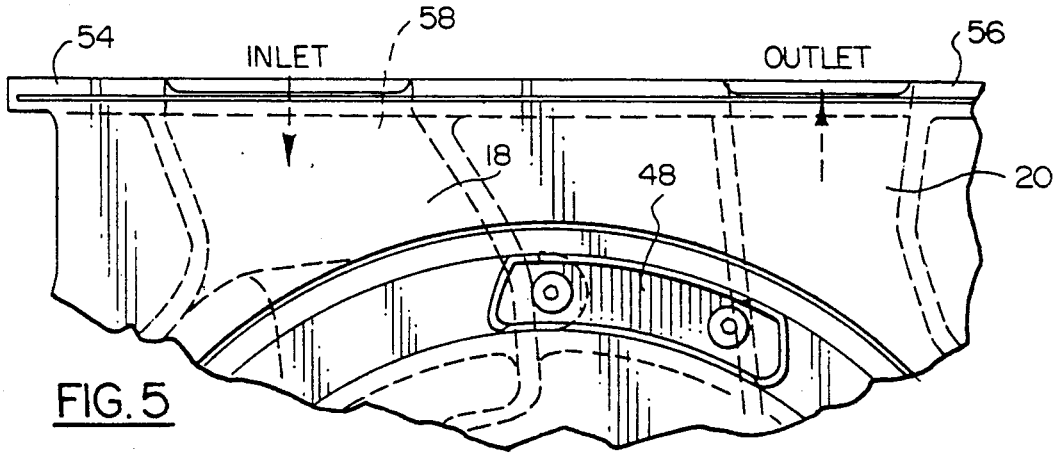
FIG. 5 is a partial sectional view taken at 5—5 of FIG. 4.

As shown in FIGS. 4 and 5, the inlet and outlet ports 18, 20 have flanges 54, 56, respectively, to which pneumatic tubing or piping can be connected. A baffle 58 is provided in the inlet port, the baffle 58 extending into each housing half 12, 14, to carry intake air out around the rows 46 of impeller blades to the radial underside of the chamber 22, i.e., to the intake side of the impeller blades.

Figure 6:
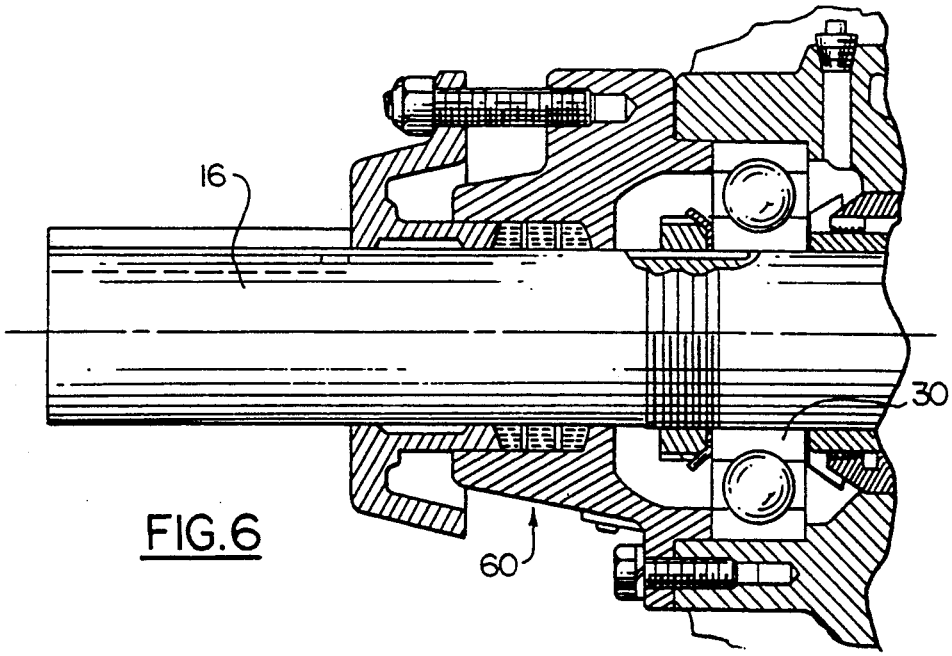
FIG. 6 illustrates an alternative shaft seal arrangement for a portion of the embodiment illustrated in FIG. 3.

As shown in FIG. 6, a gas seal 60 can be employed in lieu of a labyrinth type seal, if the compressor assembly 10 is used for a gas other than air, for example, argon, natural gas, or the like, to prevent gas from escaping out along the drive shaft 16.

Details of the impeller 32 and the stripper seal 48 can be explained with reference to FIG. 7. The stripper seal 48, only one of which is shown here, is in the form of an arcuate channel-shaped member having a flat web portion 62 with countersunk screw holes 64, through which machine screws 66 can fasten the stripper seal 48 into the receptacle 50 that is provided for it. The stripper seal 48 has a radial outer flange 68 that is generally cylindrical and extends in the circumferential direction between the outlet port and the inlet port. A generally cylindrical inner flange 70, which is co-axial with the outer flange 68, has a greater circumferential extent, both at the inlet side and at the outlet side. The stripper seal 48 is made of a softer material than the blades of the impeller, so that the fit between the impeller blades 46 and the stripper seal 48 can be as close as possible, without significant risk of damage to the blades. The stripper seal 48 can be molded or machined of Teflon (polytetrafluoroethylene) or another suitable synthetic resin with low friction characteristics.

Figure 7:
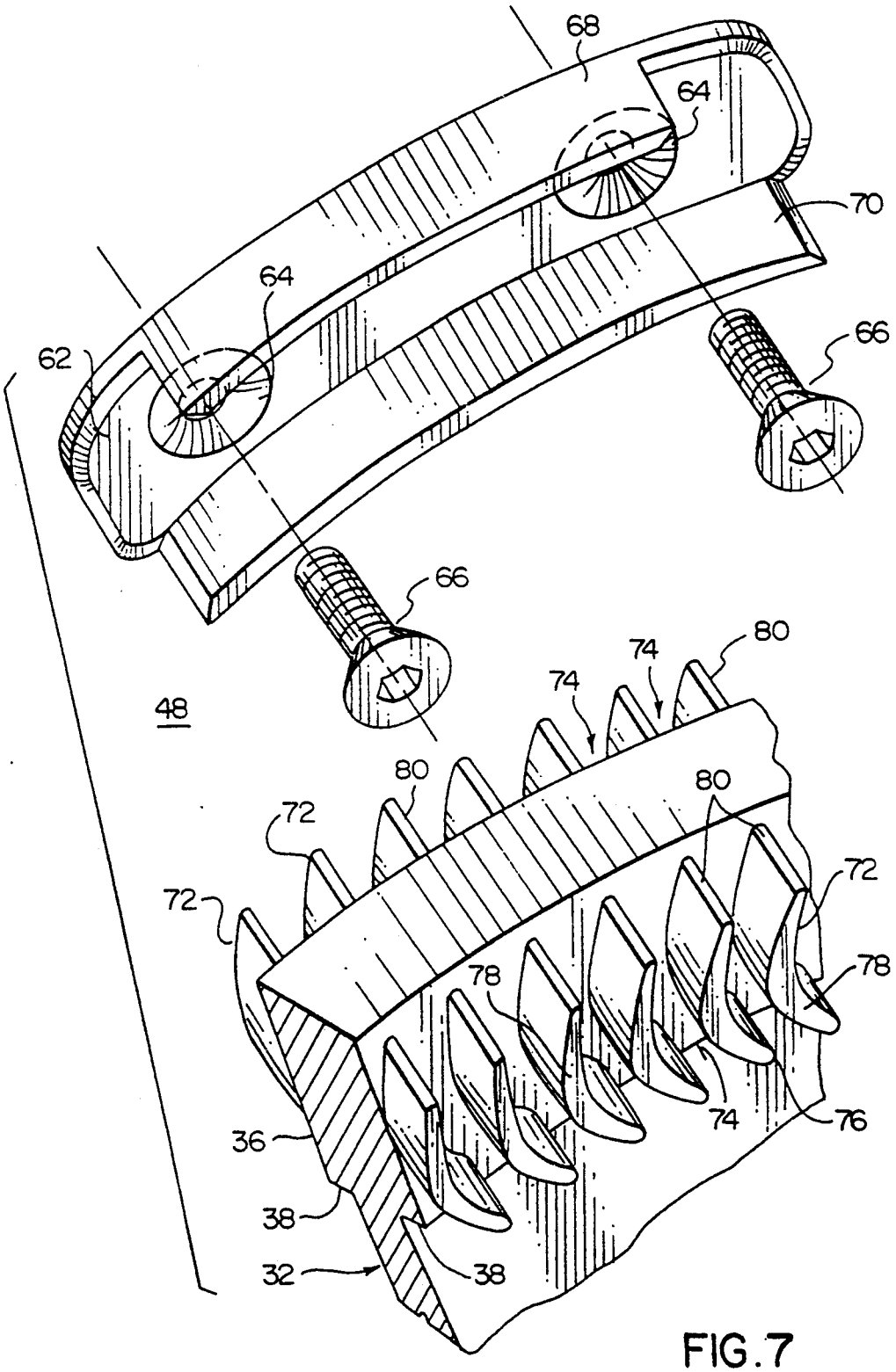
FIG. 7 is a partial assembly view of the impeller and stripper seal of the preferred embodiment of this invention.

A also shown in FIG. 7, each impeller blade row 46 is formed of a succession of blades 72 and spaces 74 between the blades. Each of the blades 72 has a generally L-shaped profile, with a rounded intake edge 76 at its radially inward side, a straight portion leading to a generally arcuate bend 78 at its mid portion, and a generally straight exit portion leading to a flat, narrow discharge edge 80 at its radially outward sides. As also shown in FIG. 7, in the preferred mode the blades 72 are positioned alternately, i.e. staggered, so that the blades 72 on each side of the impeller rim 36 are at the locations of spaces 74 between blades on the other side of the rim 36. The successive blades then define between them the spaces 74 that are of gradually increasing width from the intake edges 76 to the bends 78, and then continue to open gradually to the arcuate bends 78 to the discharge edges 80.

Figures 8, 9E:
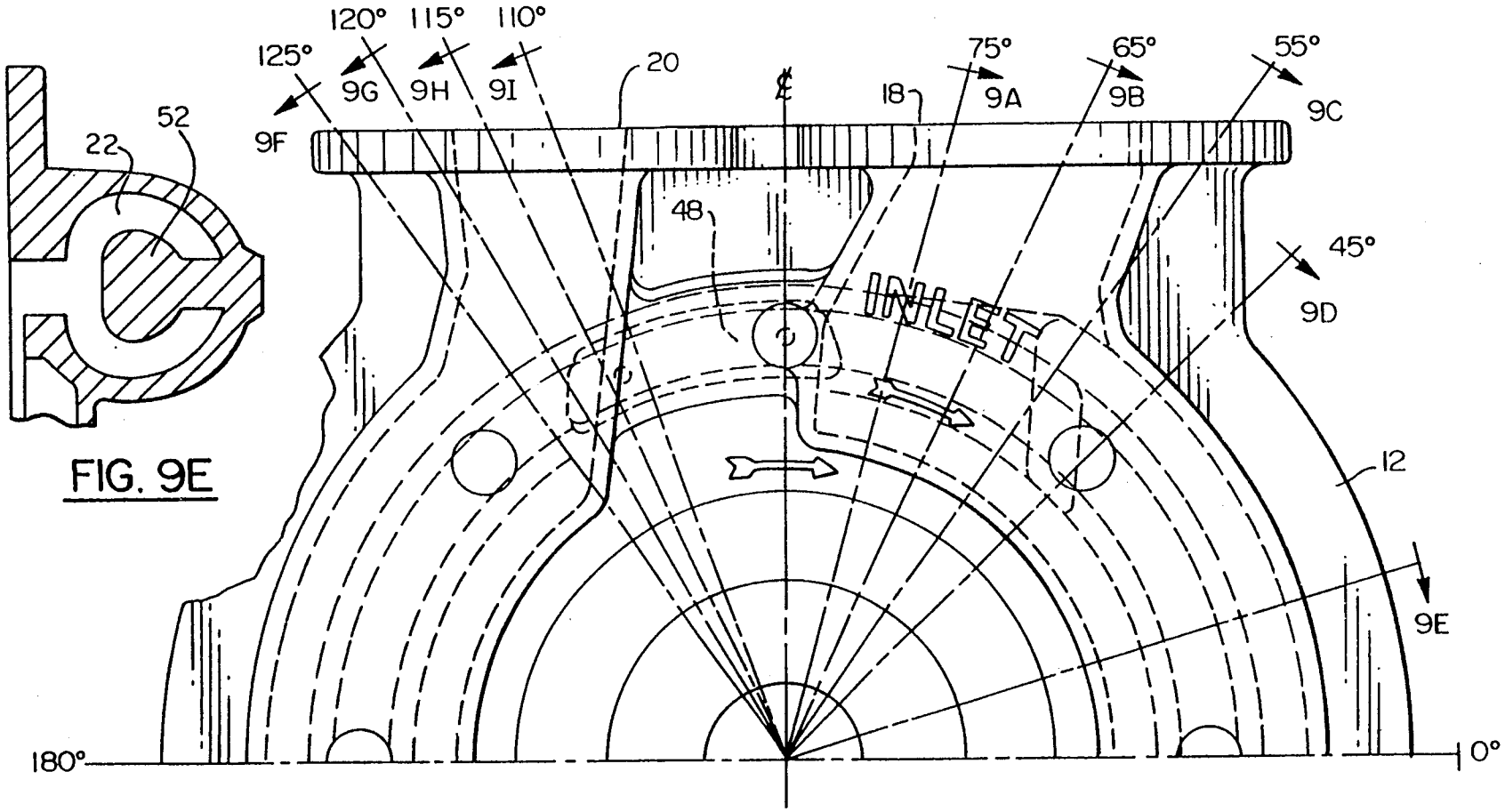

FIG. 8 shows details of the position of the stripper 48 and the chamber 22 at the inlet and outlet ports 18, 20. FIGS. 9A–9I are sections of the chamber for one side only of the housing, taken along the planes indicated in FIG. 8.

FIGS. 9A and 9B show the general configuration of the baffle 58, which defines the J-shaped cross section for the air inlet so that it opens onto the intake edge 76 of the impeller blades 72. As shown in FIGS. 9C and 9D, at the intake end of the chamber 22, the baffle 58 begins to assume a D-shaped section and this becomes the annular core 52, which is supported at one or more points by posts 82. At positions significantly away from the inlet and outlet ports 18 and 20, the chamber has the cross section as generally shown in FIG. 9E.

FIGS. 9F, 9G, 9H, 9I show the cross section of the chamber 22 at the outlet port 20, as the impeller nears the stripper area 24, where the impeller blades 72 pass through the stripper seal 48. Here, as shown in FIGS. 9F, 9G, and 9H, the radially outward part of the chamber 22 begins to open outward while the radially inward part of the chamber 22 becomes sealed off and joins with the stripper area. As shown in FIG. 9G the longer lower or inner flange 70 of the stripper seal 48 is encountered first. This serves to cut off the intake edges of the spaces 74 between the blades prior to closure of the discharge edges thereof. This feature permits a pressure between the blades to be reduced somewhat at the stripper seals to reduce noise and increase efficiency.

As shown in FIG. 9I the stripper seal 48 occupies all the area that is not required for the impeller 32. The stripper seal thus blocks the flow of high pressure gas from the outlet port 20 to the inlet port 18.

Figure 10:
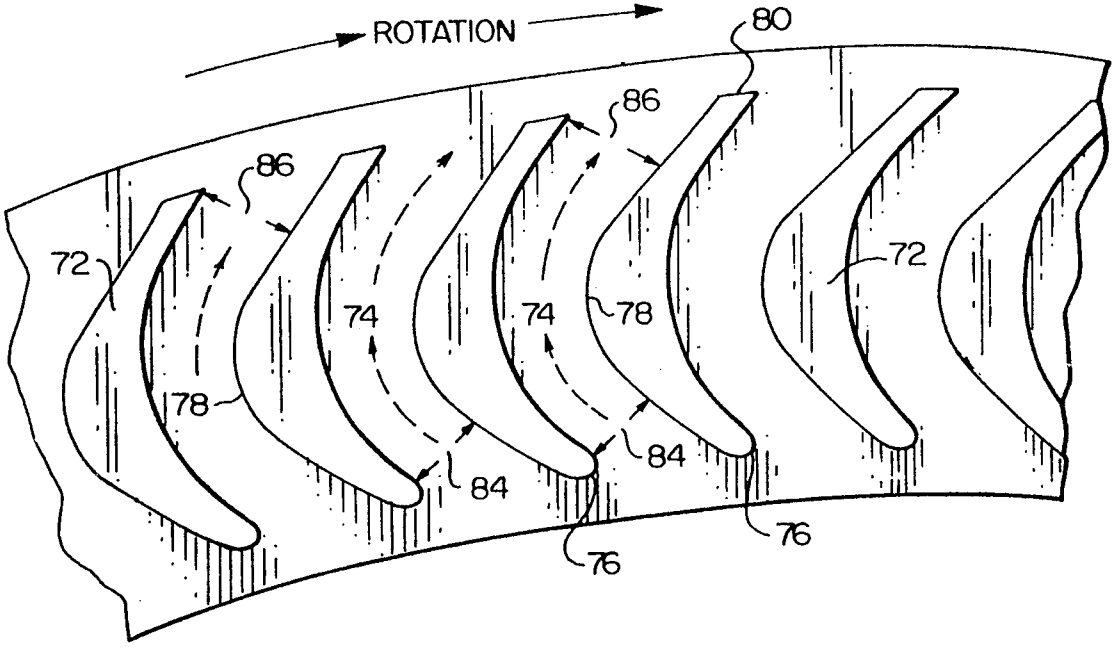
FIG. 10 shows the blade profile of the impeller of this invention.

As shown in FIG. 10, the blades 72 of the impeller have an improved profile so that the spaces 74 between them increase gradually in width as considered in the flow direction of the gas. This produces improved diffusion of the gas at the exhaust side, i.e., discharge edges 80. The width of the space increases gradually from a width 84 at the intake side to a width 86 at the discharge side. In a practical embodiment, the discharge width 86 is about 120% of the intake width 84.

While the above description relates to a double-sided impeller, the principles of this invention also clearly imply to a single-sided impeller. Also, rather than the solid stripper seal shown and described here, variants of the regenerative compressor of this invention could employ a labyrinth-style stripper.

While this invention has been described in detail with respect to a preferred embodiment, it should be understood that the invention is not limited to that precise embodiment. Rather, many modifications and variations would present themselves to those skilled in the art without departing from the scope and spirit of this invention, as defined in the appended claims.

What is claimed is:

1. Regenerative centrifugal compressor comprising:

a rotor having an axis, a rim, and a row of impeller blades that extend axially from one side of the rim, said blades having a radially inward intake edge and a radially outward discharge edge; a housing for said rotor and having a gas inlet and a compressed gas outlet angularly spaced apart, a generally annular compression chamber formed in said housing having a radial extend to envelop said impeller blades and extending circumferentially from said gas inlet to said gas outlet in the rotation direction of said rotor, the housing including an annular core extending within said compression chamber adjacent said axial tips of said impeller blades to define a toroidal pathway for gas that is impelled by said blades, the core extending generally from said inlet to said outlet in the rotational direction of the rotor to guide gas impelled by said blades from the radially outer discharge edges to the radially inner intake edges of said impeller blades; a stripper seal extending from said outlet to said inlet in the rotation direction of the rotor, said stripper seal having an open passage of substantially the same cross section as a profile of said blades in the rotational direction to strip compressed gas in said compression chamber and block compressed gas from flowing from the outlet to the inlet; and an inlet baffle formed in said housing at said gas inlet for ducting intake gas around said impeller blades and said compression chamber at said inlet to enter the compression chamber only at a radially inward side thereof.

2. The regenerative compressor of claim 1 wherein said inlet baffle defines an inlet duct of a generally J-shaped section.

3. The regenerative compressor of claim 1 wherein said inlet baffle is integrally formed with said core at an inlet end thereof.

4. The regenerative compressor of claim 1 wherein said stripper seal is in the form of an arcuate channel having inner and outer coaxial circumferential flanges respectively adjacent the intake and discharge edges of the impeller blades, said inner circumferential flange having a trailing edge extending further in the circumferential direction into said inlet than a corresponding trailing edge of said outer circumferential flange so that spaces between the impeller blades open first at the discharge edges of the said blades as said impeller blades enter the inlet from the stripper seal.

5. Regenerative centrifugal compressor comprising:

a rotor having an axis, a rim, and a row of impeller blades that extending axially from one side of the rim, each, said row of blades having a radially inward intake edge and a radially outward discharge edge, a housing for said rotor having a gas inlet and a gas outlet annually spaced apart, a generally annular compression chamber formed in said housing having an radial extent to envelop said impeller blades and extending circumferentially from said gas inlet to said gas outlet in the rotation direction of said rotor, the housing including an annular core extending within said compression chamber adjacent said axial tips of said impeller blades to define a toroidal pathway for gas that is impelled by said blades, the core extending generally from said inlet to said outlet in the rotation direction of the rotor, to guide gas impelled by said blades from the radially outer discharge edges to the radially inner intake edges of said impeller blades; a stripper seal extending from said outlet to said inlet in the rotation direction of the rotor, said stripper seal having an open passage of a cross section matching a profile of said blades in the rotational direction to strip compressed gas in said compression chamber and block compressed gas from flowing from the outlet to the inlet, said striper seal being formed as an insert made of a low-friction material softer than the material of said blades an fitted into a receptacle for the stripper seal, the stripper seal being in the form of an arcuate channel having a web portion that secures to said receptacle, and inner and outer coaxial circumferential flanges respectively adjacent the intake and discharge edges of said impeller blades; and an inlet baffle at said air inlet for guiding intake air around the blades and the chamber to enter the compression chamber at a radially inward side thereof.

6. The regenerative compressor of claim 5 wherein said stripper seal is formed of a low-friction synthetic resin.

7. The regenerative compressor of claim 6 wherein said stripper seal is formed of PTFE.

8. The regenerative compressor of claim 5 wherein said stripper seal inner circumferential flange extends circumferentially over a greater arc than the outer circumferential flange.

9. The regenerative compressor of claim 8 wherein said inner flange extends further in the circumferential direction into said outlet than does said outer flange so that spaces defined between successive impeller blades are closed off at the intake edges of the blades before they are closed off at their discharge edges as the impeller blades encounter the stripper seal.

10. The regenerative compressor of claim 8 wherein said inner flange extends farther in the circumferential direction into said inlet than does said outer flange so that spaces defined between successive impeller blades are opened at the discharge edges of the blade before they are opened at their intake edges as the impeller blades encounter the gas intake.

11. Regenerative centrifugal compressor comprising a rotor having an axis, a rim having on either axial side inner generally cylindrical edges, a pair of rows of impeller blades that extend axially from each side of the rim, each of the blades having a radially inward intake edge, a radially outward discharge edge, and an axial tip; a housing for said rotor having a gas inlet and a compressed gas outlet circumferentially spaced apart on the housing, a pair of generally annular compression chamber formed in said housing each having a radial extent to envelope a respective row of said impeller blades and each extending circumferentially from said gas inlet to said gas outlet in the rotation direction of said rotor, a pair of generally cylindrical surfaces facing the respective cylindrical inner edges of said rim; the housing also including a pair of annular cores each extending within a respective compression chamber adjacent the axial tips of said impeller blades of the associated row to define a generally helical pathway for the gas that is impelled by said blades, the core extending generally from the inlet to the outlet in the rotational direction of the rotor; a stripper seal extending from said outlet to said inlet in the rotational direction of the rotor, the stripper seal having an open passage of a cross-section matching a profile of said blades in the rotational direction to strip the compressed gas in said compression chamber and block compressed gas from flowing from the outlet to the inlet; low friction sealing rings disposed respectively on said housing circumferential surfaces to seal against said inner circumferential edges of said rotor rim; and an air inlet baffle at said air inlet for guiding intake gas around the impeller blades and the chambers to enter the compression chambers at radially inward sides thereof.

12. The regenerative compressor of claim 11 wherein said sealing rings are of a low friction synthetic resin.

13. The regenerative compression of claim 12 wherein said sealing rings are formed PTFE.

14. The regenerative compressor of claim 11 wherein the blades of the two rows are staggered so that blades on one side of the rim align with spaces defined between the blades on the other side of the rim.

15. The regenerative compressor of claim 11 wherein said blades having a generally L-shaped profile having in succession a rounded intake edge, a generally straight lead in portion, an arcuate bend, a generally straight exit portion, and a flat narrow discharge edge.

16. The regenerative compressor of claim 15 wherein successive ones of said blades define between them a space that is of gradually increasing width from the intake edges to the arcuate bends, and then continues to open gradually from the arcuate bends to the discharge edges of the blades.

17. The regenerative compressor of claim 11 wherein said annular cores each have a generally D-shaped cross section with a generally flat side facing the axial tips of the respective impeller blades and with a round outer guide surface to guide the gas impelled by said blades from the radially outer discharge edges to the radially inner intake edges thereof.

18. The regenerative compressor of claim 17 wherein each of the cores has an intake end that is continuously formed on said intake baffle.

19. Regenerative centrifugal compressor comprising a rotor having an axis, a rim, and a row of impeller blades that extend axially from one side of the rim each having a radially inward intake edge and a radially outward discharge edge; a housing for said rotor having an air inlet and an air outlet angularly spaced apart, a generally annular compression chamber formed in said housing having a radially extent to envelop said impeller blades and extending circumferentially from said air inlet to said air outlet in the rotation direction of said rotor, the housing including an annular core extending within said compression chamber adjacent said axial tips of said impeller blades to define a helical pathway for gas that is impelled by said blades, the core extending generally from said inlet to said outlet in the rotation direction of the rotor; said core having a generally D-shaped cross section with a round outer guide surface to guide gas impelled by said blades from the radially outer discharge edges to the radially inner intake edges of said impeller blades; a stripper seal extending from said outlet to said inlet in the rotation direction of the rotor, said stripper seal having an open passage of a cross section matching a profile of said blades in the rotation direction to strip compressed gas in said compression chamber and block compressed gas from flowing from the outlet to the inlet, said stripper seal being formed of a low-friction material softer than the material of said blades and fitted into a receptacle for the stripper seal in said housing, the stripper seal being in the form of an arcuate channel having a web portion that secures to said housing, said stripper seal including inner and outer coaxial circumferential flanges respectively adjacent the intake and discharge edges of said impeller blades; said inner circumferential flange extending farther into said inlet in said rotational direction that said outer circumferential flange so that spaces between successive blades are closed off at the discharge edges of said blades as said impeller blades encounter the stripper seal; and an inlet baffle at said air inlet for guiding intake air around the blades and the chamber to enter the compression chamber at a radially inward side thereof.

20. The regenerative compressor of claim 1 wherein said annular core has its inlet end continuously formed with said inlet baffle.

* * * * *

UNITED STATES PATENT AND TRADEMARK OFFICE

CERTIFICATE OF CORRECTION

PATENT NO. : 5,143,511

DATED : September 1, 1992

INVENTOR(S) : Verneau et al.

It is certified that error appears in the above—identified patent and that said Letters Patent is hereby corrected as shown below:

Column 8, claim 5, line 55, please delete "annually" and insert --angularly--

Column 9, claim 5, line 10, please delete "an" and insert --and--

Column 9, claim 11, line 52, please delete "chamber" and insert --chambers--

Column 11, claim 19, line 11, please delete "that" and insert --than--

Column 12, claim 20, line 7, please delete "1" and insert --19--

Signed and Sealed this

Thirty-first Day of August, 1993

Bruce Lehman

*Attest:*

BRUCE LEHMAN

*Attesting Officer*

*Commissioner of Patents and Trademarks*